US009581339B2

(12) United States Patent
Yang et al.

(10) Patent No.: US 9,581,339 B2
(45) Date of Patent: Feb. 28, 2017

(54) COOKING APPARATUS

(71) Applicant: SAMSUNG ELECTRONICS CO., LTD., Suwon-si, Gyeonggi-do (KR)

(72) Inventors: Sung Pyo Yang, Yongin-si (KR); Han Seong Kang, Hwasung-si (KR); Byoung Hoon Moon, Seoul (KR); Pung Yeun Cho, Suwon-si (KR); Yun Ic Hwang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 217 days.

(21) Appl. No.: 14/087,787

(22) Filed: Nov. 22, 2013

(65) Prior Publication Data

US 2014/0175085 A1 Jun. 26, 2014

(30) Foreign Application Priority Data

Dec. 21, 2012 (KR) ..... 10-2012-0150759

(51) Int. Cl.
*F24C 15/32* (2006.01)
*F22B 1/28* (2006.01)
*F24C 15/00* (2006.01)

(52) U.S. Cl.
CPC ..... *F24C 15/327* (2013.01); *F22B 1/284* (2013.01); *F22B 1/285* (2013.01); *F24C 15/003* (2013.01)

(58) Field of Classification Search
None
See application file for complete search history.

(56) References Cited

U.S. PATENT DOCUMENTS 5,103,076 A * 4/1992 Houkuwa ..... A47J 27/16 219/401
6,135,062 A * 10/2000 Palmers ..... F22D 5/26 122/40
6,595,112 B2 * 7/2003 Durth ..... A21B 3/04 126/369

(Continued)

FOREIGN PATENT DOCUMENTS

DE 19912444 A1 9/2000
DE 10234625 A1 2/2004

(Continued)

OTHER PUBLICATIONS

Partial European Search Report mailed May 16, 2014 in related European Application No. 13194993.5.

(Continued)

*Primary Examiner* — Joseph M Pelham
(74) *Attorney, Agent, or Firm* — Staas & Halsey LLP

(57) ABSTRACT

A cooking apparatus is provided. The cooking apparatus includes a main body provided with a cooking chamber, and a steam supply device generating steam to supply the steam to the cooking chamber. The steam supply device includes a water storage unit to store water, a steam generator that is supplied with water from the water storage unit to generate steam, a water supply tube to transfer water in the water storage unit to the steam generator, and a water collection tube to transfer residual water in the steam generator to the water storage unit. Accordingly, a period to put water may be increased since the residual water in the steam generator is collected.

18 Claims, 8 Drawing Sheets

(56) References Cited

U.S. PATENT DOCUMENTS 6,894,257 B2 * 5/2005 Kim ..... H05B 6/6479 219/401
7,045,745 B2 * 5/2006 Kim ..... F24C 15/327 126/348
7,091,454 B2 * 8/2006 Cho ..... F24C 15/327 219/401
7,304,271 B2 * 12/2007 Cho ..... F24C 15/327 126/20
7,323,662 B2 * 1/2008 Cho ..... F24C 15/327 126/20
7,348,520 B2 * 3/2008 Wang ..... F24C 15/327 126/20
7,537,004 B2 * 5/2009 Reay ..... F24C 15/327 126/20
7,989,737 B2 * 8/2011 Jeon ..... A47J 27/04 126/20
8,288,690 B2 * 10/2012 Boubeddi ..... F22B 1/284 126/348
2005/0139588 A1 * 6/2005 Kim ..... F24C 15/327 219/400
2006/0011071 A1 * 1/2006 Cho ..... F24C 15/327 99/417
2006/0011607 A1 * 1/2006 Cho ..... F24C 15/327 219/401
2006/0096970 A1 * 5/2006 Yang ..... F24C 15/327 219/401
2006/0237428 A1 * 10/2006 Cho ..... F24C 15/327 219/401
2006/0278630 A1 * 12/2006 Sung ..... B24B 49/105 219/401
2007/0062927 A1 * 3/2007 Sells ..... F24C 15/327 219/401
2008/0075823 A1 * 3/2008 Jeon ..... F24C 15/327 426/510
2008/0078243 A1 * 4/2008 Jeon ..... A47J 31/56 73/290 R
2008/0078755 A1 * 4/2008 Jeon ..... F22B 1/288 219/401
2008/0163757 A1 * 7/2008 Jeon ..... F24C 15/327 99/330
2008/0163758 A1 * 7/2008 Jeong ..... A47J 27/04 99/330
2008/0236404 A1 * 10/2008 Ose ..... F24C 7/08 99/327
2009/0250452 A1 * 10/2009 Tse ..... F24C 15/327 219/401
2010/0006084 A1 * 1/2010 Kitayama ..... F24C 15/023 126/190
2010/0064902 A1 * 3/2010 Sakane ..... F24C 15/327 99/352
2010/0230396 A1 * 9/2010 Boubeddi ..... F22B 1/284 219/399
2012/0006207 A1 * 1/2012 Shimoda ..... F24C 15/327 99/357
2014/0175085 A1 * 6/2014 Yang ..... F22B 1/284 219/401

FOREIGN PATENT DOCUMENTS

DE 102004006973 A1 10/2004
DE 102009055146 A1 6/2011
EP 2083223 A1 10/2007
EP 2 461 107 6/2012

OTHER PUBLICATIONS

Office Action mailed on May 11, 2016 in European Patent Application No. 13 194 993.5.

* cited by examiner

COOKING APPARATUS

CROSS-REFERENCE TO RELATED APPLICATIONS

This application is related to, and claims priority to, Korean Patent Application No. 10-2012-0150759, filed on Dec. 21, 2012 in the Korean Intellectual Property Office, the disclosure of which is incorporated herein by reference.

BACKGROUND

1. Field

Embodiments of the present invention relate to a cooking apparatus having a steam supply device to supply steam to a cooking chamber.

2. Description of the Related Art

A cooking apparatus has been used in which food is able to be cooked using steam heat.

Such a cooking apparatus includes a steam supply device to supply steam to a cooking chamber in which food is cooked.

The steam supply device includes a water storage unit to store water and a steam generator to generate steam by heating water transferred from the water storage unit, and supplies steam generated by the steam generator to a cooking chamber so as to allow food in the cooking chamber to be cooked by the steam.

SUMMARY

Therefore, it is an aspect of the present invention to provide a cooking apparatus having a steam supply device capable of more efficiently utilizing water.

It is an aspect of the present invention to provide a cooking apparatus capable of preventing drop water generated during attachment and detachment of a water storage container from being introduced into a main body.

It is an aspect of the present invention to provide a cooking apparatus capable of maintaining a state where an opening, through which a water storage container is attached and detached, is stably closed by a water supply door.

Additional aspects of the invention will be set forth in part in the description which follows and, in part, will be obvious from the description, or may be learned by practice of the invention.

In accordance with an aspect of the present invention, a cooking apparatus includes a main body provided with a cooking chamber, and a steam supply device generating steam to supply the steam to the cooking chamber, wherein the steam supply device includes a water storage unit to store water, a steam generator that is supplied with water from the water storage unit to generate steam, a water supply tube to transfer water in the water storage unit to the steam generator, and a water collection tube to transfer residual water in the steam generator to the water storage unit.

The steam supply device may include a steam supply tube to transfer steam generated by the steam generator to the cooking chamber.

The steam supply device may include a water supply pump that is disposed at the water supply tube and allows water to be moved from the water storage unit to the steam generator.

The steam supply device may include a water collection pump that is disposed at the water collection tube and allows water to be moved from the steam generator to the water storage unit.

The steam supply device may include a water flow sensing sensor disposed at the water supply tube to sense flow of water.

The water storage unit may include a water storage case mounted within the main body and a water storage container that is separately installed to the water storage case, and the main body may include an opening through which the water storage container passes and a water supply door that is rotatably mounted, at a lower end thereof, to a front surface of the main body to open and close the opening during rotation of the water supply door.

The water supply door may include a guide rib that is provided on an inner surface thereof and is formed in a U-shape oriented downward, and a guide portion protruding inside the water supply door from an inner surface lower portion thereof, a lower end of the guide rib being formed at both sides of the guide portion.

The water storage case may include a drop water storage portion recessed downward at a lower portion thereof to receive and gather drop water.

The main body may include a non-magnetic portion made of a non-magnetic substance that is provided in a part adjacent to the opening and a magnetic portion made of a magnetic substance that is provided in the part adjacent to the opening, and the water supply door may include at least one magnet disposed to face the non-magnetic portion.

The at least one magnet may include a first magnet a portion of that faces the magnetic portion and the remainder of which faces the non-magnetic portion, and a second magnet the entirety of which faces all of the non-magnetic portion.

The main body may include a button disposed in the part adjacent to the opening, a protrusion length of the button alternately varying depending on the number of times the button is pressed.

In accordance with an aspect of the present invention, a cooking apparatus includes a main body provided with a cooking chamber, and a steam supply device generating steam to supply the steam to the cooking chamber, wherein the steam supply device includes a water storage container that is attachable to, and detachable from, the main body, and a steam generator that is supplied with water from the water storage container to generate steam, the main body includes an opening through which the water storage container is attached and detached, a water supply door to open and close the opening, a non-magnetic portion made of a non-magnetic substance that is provided in a part adjacent to the opening, and a magnetic portion made of a magnetic substance that is provided in the part adjacent to the opening, and the water supply door includes at least one magnet disposed to face the non-magnetic portion.

In accordance with a further aspect of the present invention, a cooking apparatus includes a main body provided with a cooking chamber, a water storage unit to store water, and a steam generator that is supplied with water from the water storage unit to generate steam, wherein the water storage unit includes a water storage case mounted within the main body and a water storage container that is separately installed to the water storage case, the main body includes an opening through which the water storage container is attached and detached, a water supply door which is rotatably mounted, at a lower end thereof, to the main body to open and close the opening, and the water supply door includes a guide rib that is provided on an inner surface thereof and is formed in a U shape toward downward.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
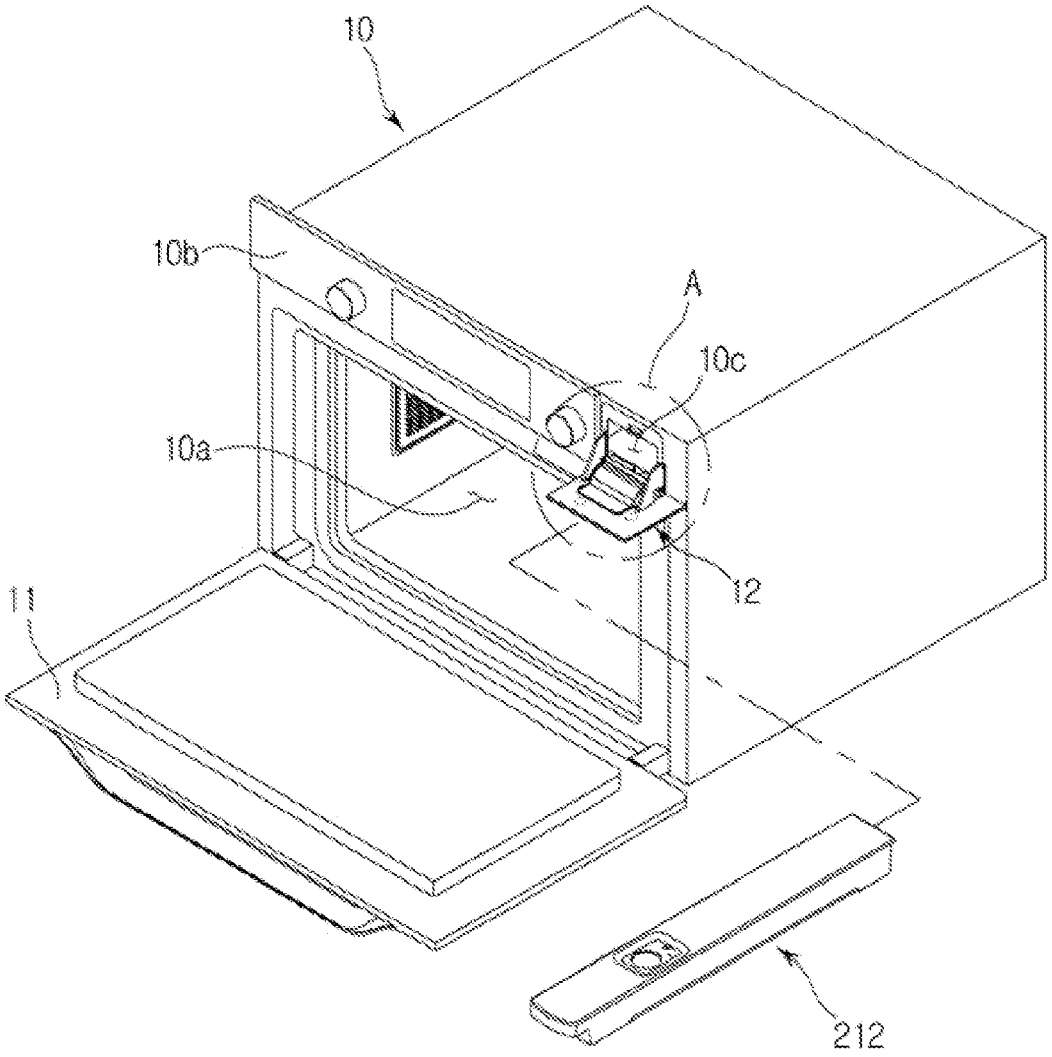
FIG. 1 illustrates a cooking apparatus according to an embodiment of the present invention.

Reference will now be made in detail to the embodiments, examples of which are illustrated in the accompanying drawings, wherein like reference numerals refer to the like elements throughout. The embodiments are described below to explain the present invention by referring to the figures.

A cooking apparatus including a steam supply device according to an embodiment of the present invention is described in detail with reference to the drawings, wherein like reference numerals refer to like elements throughout.

As illustrated in FIG. 1, a cooking apparatus according to an embodiment of the present invention includes a main body 10 provided with a cooking chamber 10*a* into which food to be cooked may be inserted, and a door 11 mounted on a front surface of the main body 10 to open and close the cooking chamber. The main body 10 may be provided, at a front surface upper portion thereof, with a control panel 10*b* that may manipulate various conditions such as an output of the cooking apparatus and a cooking time.

Figure 2:
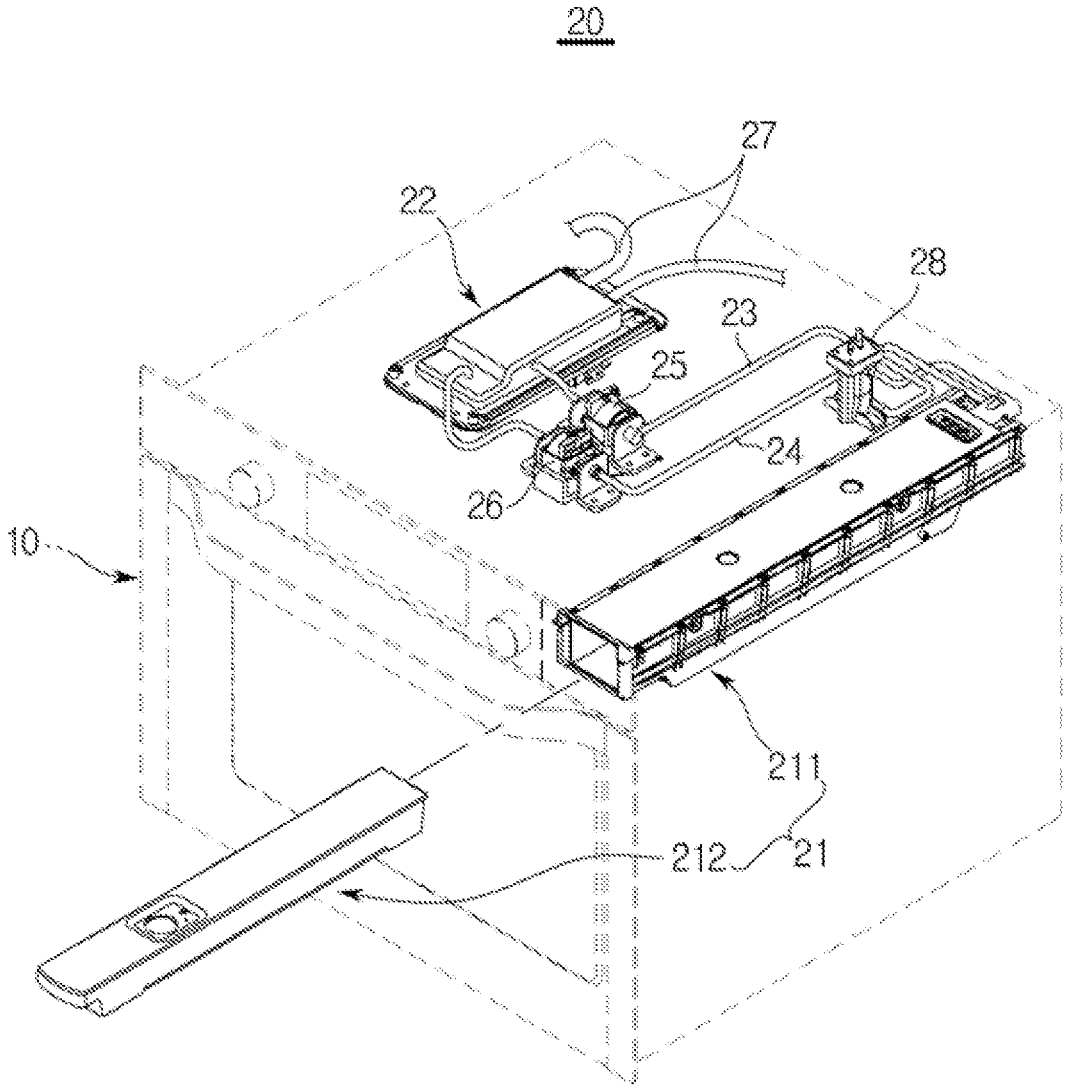
FIG. 2 illustrates a steam supply device included in a cooking apparatus according to an exemplary embodiment of the present invention.
Figure 3:
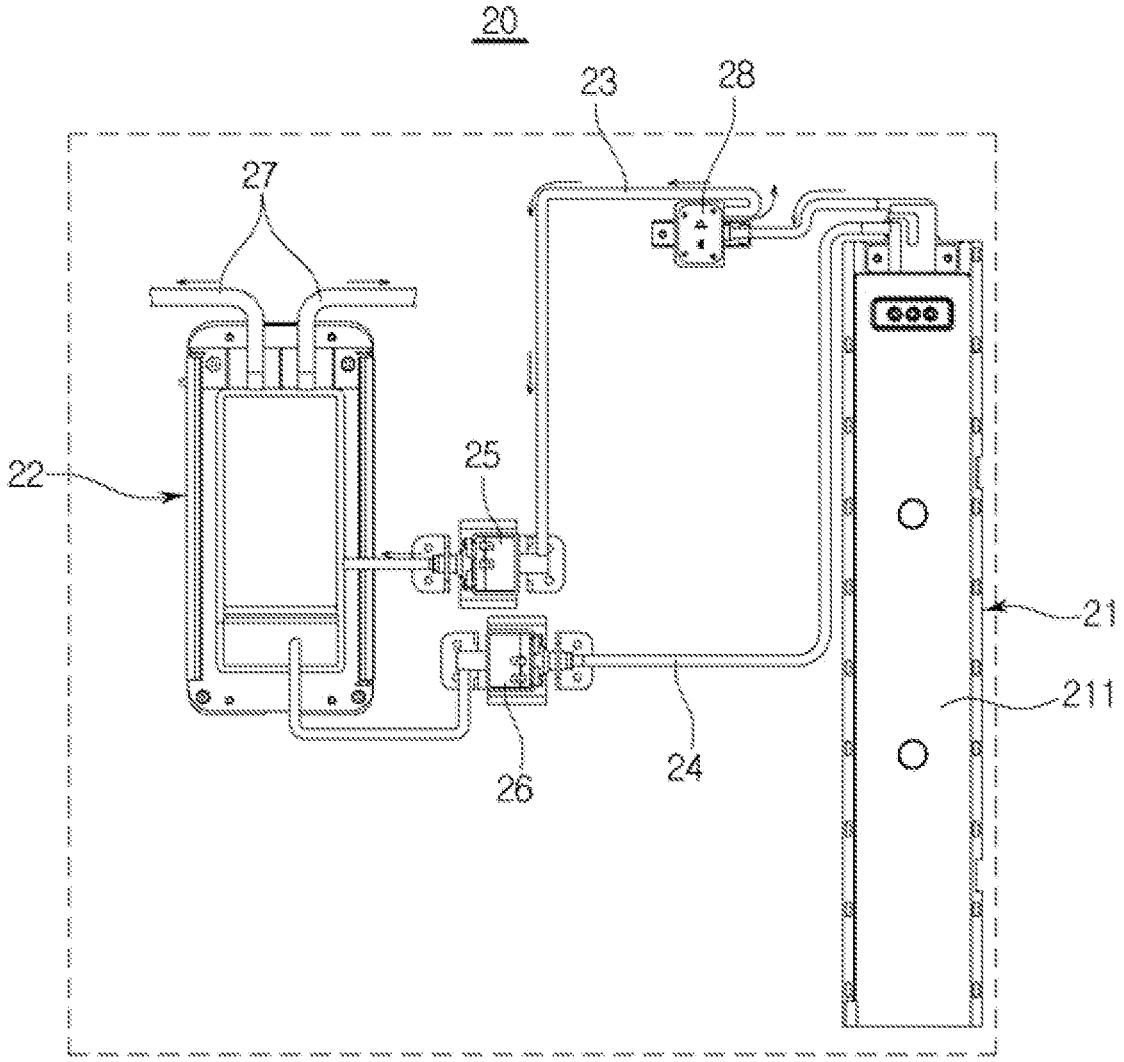
FIGS. 3 and 4 a illustrating an exemplary operation of a steam supply device included in the cooking apparatus according to an embodiment of the present invention.

As illustrated in FIGS. 2 and 3, the main body 10 has a built-in steam supply device 20 to generate and supply steam to the cooking chamber 10*a*, for example, at an upper portion of the main body 10. The steam supply device 20 includes a water storage unit 21 and a steam generator 22, wherein the water storage unit 21 stores water required for a steam generator, and the steam generator 22 is supplied with water from the water storage unit 21 and generates steam. The water storage unit 21 and the steam generator 22 may be connected to each other through a water supply tube 23 to guide water of the water storage unit 21 to the steam generator 22. A water collection tube 24 may guide residual water in the steam generator 22 to the water storage unit 21.

The steam generator 22 may be connected with steam supply tubes 27 to guide steam generated by the steam generator 22 to the cooking chamber 10*a*. According to an exemplary embodiment, two steam supply tubes 27 are provided, and thus steam generated by the steam generator 22 may be guided through the steam supply tubes 27 to both sides of the cooking chamber 10*a*, respectively.

The steam supply device 20 includes a water supply pump 25, which is disposed at the water supply tube 23 and allows water to be transferred from the water storage unit 21 through the water supply tube 23 to the steam generator 22, and a water collection pump 26, which is disposed at the water collection tube 24 and allows residual water in the steam generator 22 to be collected from the steam generator 22 through the water collection tube 24 to the water storage unit 21. The water supply tube 23 may be provided with a water flow sensing sensor 28 disposed between the water storage unit 21 and the water supply pump 25 to sense whether water flows through the water supply tube 23.

The water storage unit 21 includes a water storage case 211 mounted within the main body 10 and a movable water storage container 212, which may be separately installed to the water storage case 211, and may be attached to, and detached from, the main body 10. The water storage case 211 may have an open front side so as to attach and detach the water storage container 212. The water storage case 211 may include, at a lower portion thereof, a drop water storage portion 211 a (see, for example, FIG. 7) recessed downward in order to receive and gather drop water generated during attachment and/or detachment of the water storage container 212. Accordingly, a user may replenish water to be used for the steam generator 22 by separating the water storage container 212 from the main body 10, putting water into the water storage container 212, and mounting the water storage container 212 to the main body 10.

Figure 5:
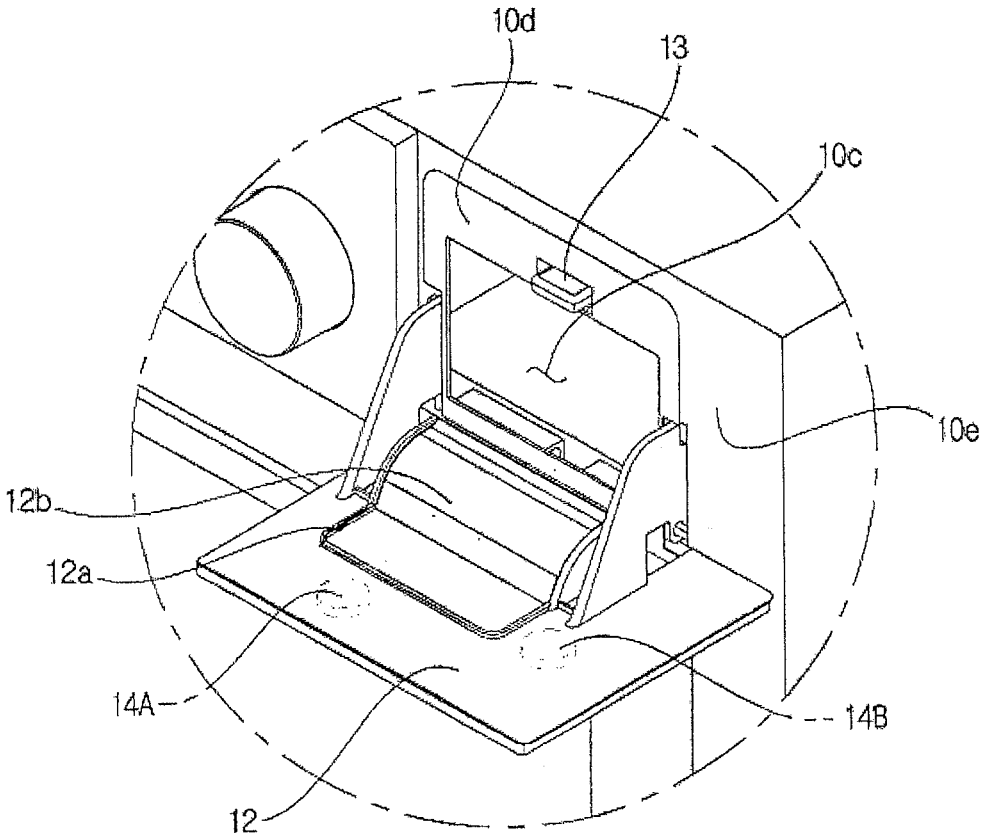
FIG. 5 is an enlarged view of portion A illustrated in FIG. 1.

As illustrated in FIG. 5, a side of the front surface upper portion of the main body 10 may be provided with an opening 10*c* through which the water storage container 212 is attachable to, and detachable from, the water storage case 211 mounted within the main body 10. The opening 10*c* may be provided to correspond to the water storage case 211, and may be opened and closed by a water supply door 12 that is rotatably mounted on the front surface of the main body 10. The water supply door 12 may be rotatably mounted, at a lower end thereof, to the main body 10 to open and close the opening 10*c* while rotating about the lower end.

The water supply door 12 may be provided, on an inner surface thereof, with a guide rib 12*a*, which may formed in a U-shape oriented downward of the water supply door 12 (a U-shape illustrated rearward in FIG. 5) so as to serve to receive and gather drop water dropping on the inner surface of the water supply door 12. The water supply door 12 may be provided, at an inner surface lower portion thereof, with a guide portion 12*b* extending rearward, inside the opening 10*c* so as to have an arc-shaped cross-section. A lower end portion of the guide rib 12*a* may be provided at both sides of the guide portion 12*b*. Thus, water gathered by the guide rib 12*a* may be guided into the water storage case 211 disposed inside the opening 10*c* by the guide portion 12*b*.

To maintain a state in which the opening 10*c* is closed by the water supply door 12, a part adjacent to the opening 10*c* of the main body 10 may include a non-magnetic portion 10*d* made of a non-magnetic substance and a magnetic portion 10*e* made of a magnetic substance, and the water supply door 12 may include magnets 14A and 14B. According to an exemplary embodiment, the non-magnetic portion 10*d* may be arranged around the opening 10*c*, and the magnetic portion 10*e* arranged outside the non-magnetic portion 10*d*. Accordingly, the water supply door 12 maintains a closed state of the opening 10*c* by magnetic force acting between the magnets 14A and 14B and the magnetic portion 10*e*.

The magnets 14A and 14B may be arranged such that most regions thereof face the non-magnetic portion 10*d*. This enables easy operation of the water supply door 12 with a small force by allowing only a small magnetic force to act between the magnets 14A and 14B and the magnetic portion 10*e* by spacing the magnetic portion 10*e* and the magnets 14A and 14B a certain distance from each other.

Figure 6:
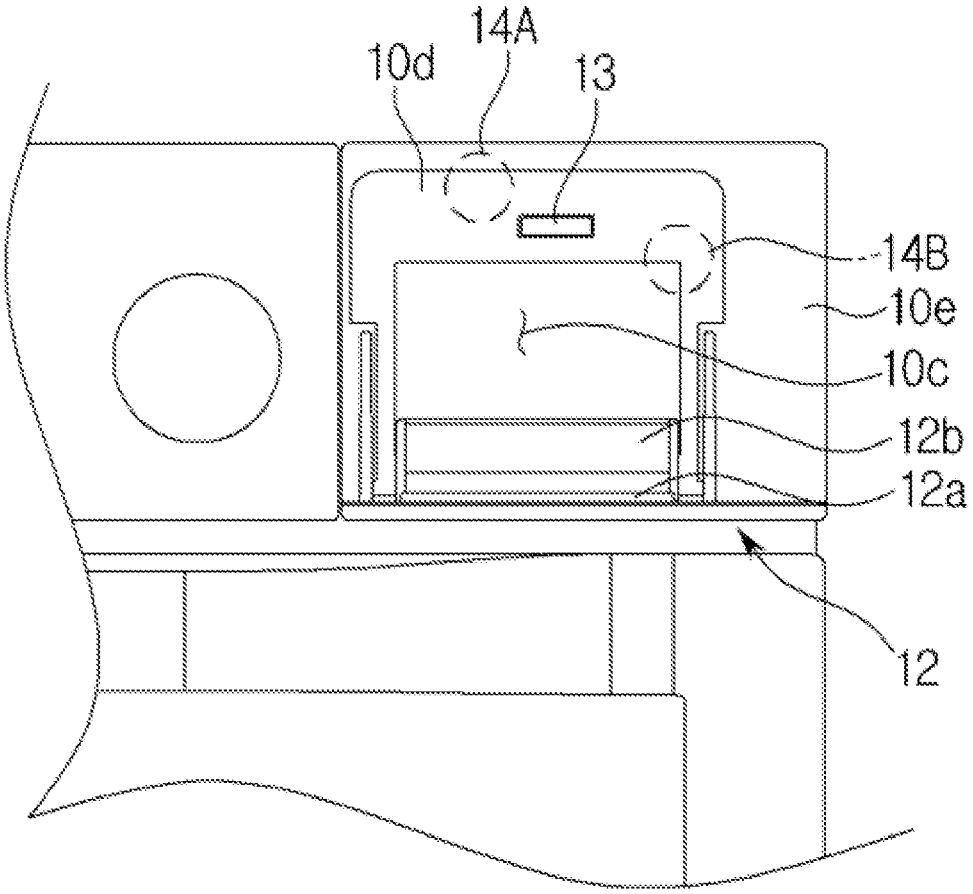
FIG. 6 illustrates an exemplary a part adjacent to an opening provided in a main body.

According to an exemplary embodiment, the magnets 14A and 14B include a first magnet 14A having only a portion of which faces the magnetic portion 10*e* and the remainder of which faces the non-magnetic portion 10*d*, and a second magnet 14B, the entirety of which faces the non-magnetic portion 10*d*, as illustrated in FIG. 6.

A part adjacent to the opening 10*c* of the main body 10 may include a button 13, a protrusion distance of which alternately varies depending on a number of times the button 13 is pressed. Accordingly, the button 13 selectively protrudes forward through the water supply door 12 depending on the number of times the button 13 is pressed by a user, thereby pushing the upper end of the water supply door 12. Since the water supply door 12 maintains the state of closing the opening 10*c* by a small magnetic force acting between the magnets 14A and 14B and the magnetic portion 10*e*, the water supply door 12 may be pushed, at the upper end thereof, by the button 13 depending on protrusion thereof to be spaced apart from the opening 10*c*, and the water supply door 12 rotate about the lower end thereof by gravity. Consequently, the opening 10*c* may be opened.

The steam generator 22 includes a heater (not shown) to apply heat, and generates steam by heating water transferred to the steam generator 22.

An exemplary operation of a cooking apparatus is described in detail with reference to the drawings.

In cooking food using steam, the water supply pump 25 may be operated and water may be supplied from the water storage unit 21 through the water supply tube 23 to the steam generator 22, as illustrated in FIG. 3. Since water supplied to the steam generator 22 is heated and evaporated in the steam generator 22, steam is generated by the steam generator 22. Steam generated by the steam generator 22 may be transferred to both sides of the cooking chamber 10*a* through two steam supply tubes 27, thereby allowing food to be cooked in the cooking chamber 10*a*.

Figure 4:
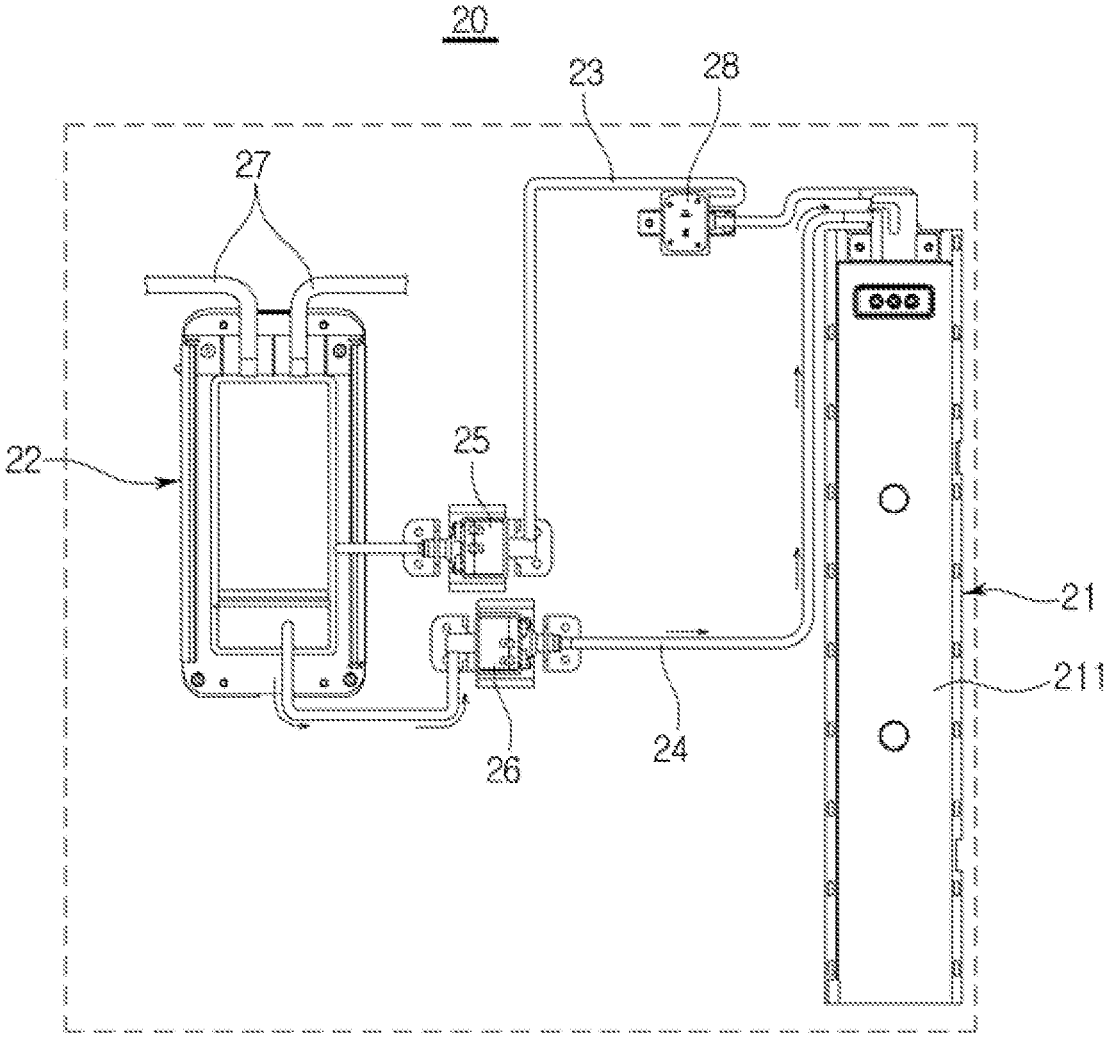

As illustrated in FIG. 4, after cooking of food is completed through steam, the operation of the water supply pump 25 may be stopped. The water flow sensing sensor 28 disposed at the water supply tube 23 senses whether water moves through the water supply tube 23, thus identifying whether the water supply is blocked. Since the water flow sensing sensor 28 senses whether water is supplied in a state in which water is not supplied to the steam generator 22, the steam generator 22 may be operated more safely.

After a blocking to the water supply is identified, the water collection pump 26 may be operated. As illustrated in FIG. 4, residual water in the steam generator 22 is transferred through the water collection tube 24 to the water storage unit 21 depending on the operation of the water collection pump 26. Accordingly, since residual water in the steam generator 22 is collected to the water storage unit 21 to be reused, it may be possible to efficiently use water. Thus, a period between adding water into the water storage container 212 by a user is increased. Therefore, convenience in operating the cooking apparatus is increased.

When all water in the water storage container 212 is used, depending on use of the cooking apparatus, a user separates the water storage container 212 from the main body 10 through the opening 10*c* in the state of opening the opening 10*c* by rotating the water supply door 12 to put water into the water storage container 212, and mounts the water storage container 212 inside the main body 10 through the opening 10*c*.

Figure 7:
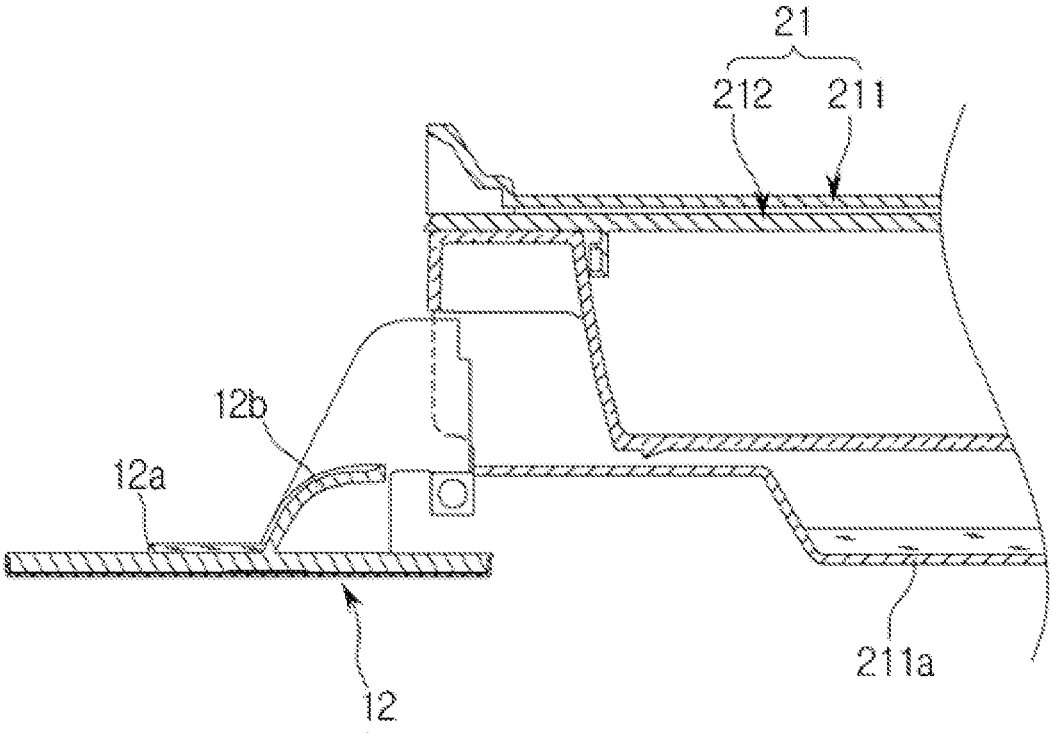
FIGS. 7 and 8 illustrate an exemplary opening and closing state of a water supply door included in a cooking apparatus according to an embodiment of the present invention.
Figure 8:
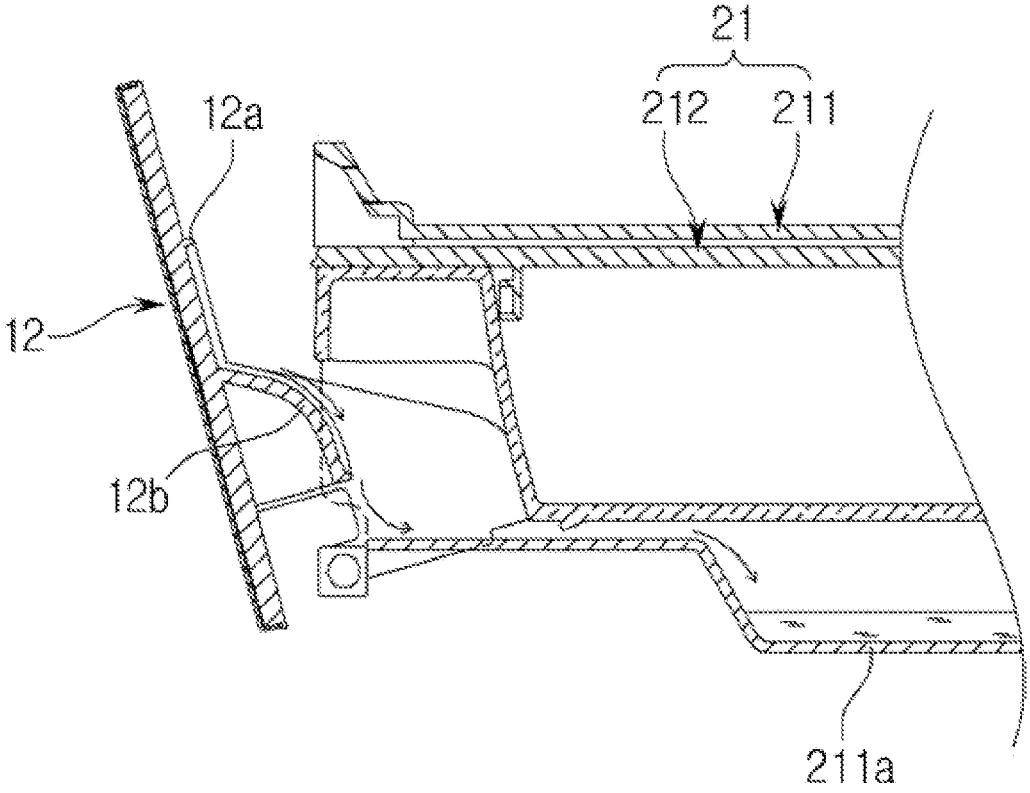

A portion of water may unavoidably drop on the inner surface of the water supply door 12 during attachment and/or detachment of the water storage container 212 in opening the water supply door 12. Drop water dropping on the inner surface of the water supply door 12 may be gathered on the inner surface of the water supply door 12 by the guide rib 12*a*, as illustrated in FIG. 7, and guided through the opening 10*c* into the water storage case 211 positioned inside the opening 10*c* by the guide portion 12*b* during closing of the opening 10*c* with the water supply door 12, as illustrated in FIG. 8. Since water guided into the water storage case 211 may be stored in the drop water storage portion 211 a provided at the lower portion of the water storage case 211, it may be possible to prevent drop water from being introduced into other components within the main body 10.

Since residual water in a steam generator may be collected to a water storage unit for reuse, it may be possible to efficiently use water, and thus a water supply period may be increased.

Since drop water generated during attachment and detachment of a water storage container is guided to a water storage case, the drop water may be prevented from being introduced into a main body.

Furthermore, it may be possible to maintain a state in which a water supply door stably closes an opening by magnetic force acting between a magnet provided in the water supply door and a magnetic portion provided in a part adjacent to the opening.

Although a few embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A cooking apparatus comprising:

a main body provided with a cooking chamber and a rotatably mounted door; and a steam supply device generating steam to supply the steam to the cooking chamber, wherein the steam supply device comprises a water storage unit to store water, a steam generator that is supplied with water from the water storage unit to generate steam, a water supply tube to transfer water in the water storage unit to the steam generator, a water collection tube to transfer residual water in the steam generator to the water storage unit, and a water flow sensor disposed at the water supply tube to sense flow of water to the steam generator, and wherein the rotatably mounted door includes a rib on an inner surface of the door configured to gather water that drops from the steam supply device onto the inner surface of the door.

2. The cooking apparatus according to claim 1, wherein the steam supply device comprises a steam supply tube to transfer steam generated by the steam generator to the cooking chamber.

3. The cooking apparatus according to claim 1, wherein the steam supply device comprises a water supply pump that is disposed at the water supply tube that moves water from the water storage unit to the steam generator.

4. The cooking apparatus according to claim 1, wherein the steam supply device comprises a water collection pump that is disposed at the water collection tube that moves water from the steam generator to the water storage unit.

5. A cooking apparatus comprising:

a main body provided with a cooking chamber; and a steam supply device generating steam to supply the steam to the cooking chamber, wherein the steam supply device comprises a water storage unit to store water, a steam generator that is supplied with water from the water storage unit to generate steam, a water supply tube to transfer water in the water storage unit to the steam generator, and a water collection tube to transfer residual water in the steam generator to the water storage unit, and wherein the water storage unit comprises a water storage case mounted within the main body and a water storage container that is separately installed to the water storage case; and the main body comprises an opening through that the water storage container passes, and a water supply door that is rotatably mounted, at a lower end thereof, to a front surface of the main body to open and close the opening during rotation of the water supply door.

6. The cooking apparatus according to claim 5, wherein the water supply door comprises a guide rib that is provided on an inner surface thereof and is formed in a U-shape oriented downward, and a guide portion protruding inside the water supply door from an inner surface lower portion thereof, a lower end of the guide rib being formed at both sides of the guide portion.

7. The cooking apparatus according to claim 6, wherein the water storage case comprises a drop water storage portion recessed downward at a lower portion thereof to receive and gather drop water that has dropped on the water storage case.

8. The cooking apparatus according to claim 5, wherein:

the main body comprises a non-magnetic portion that is provided in a part adjacent to the opening of the main body and a ferromagnetic portion that is provided in the part adjacent to the opening of the main body; and the water supply door comprises at least one magnet disposed to face the non-magnetic portion.

9. The cooking apparatus according to claim 8, wherein the at least one magnet comprises a first magnet a portion of that faces the ferromagnetic portion and the remainder of that faces the non-magnetic portion, and a second magnet the entirety of that faces all of the non-magnetic portion.

10. The cooking apparatus according to claim 8, wherein the main body comprises a button disposed in the part adjacent to the opening of the main body, a protrusion length of the button varying depending on a number of times the button is pressed.

11. A cooking apparatus comprising:

a main body provided with a cooking chamber; and a steam supply device generating steam to supply the steam to the cooking chamber, wherein:

the steam supply device comprises a water storage container that is attachable to, and detachable from, the main body, and a steam generator that is supplied with water from the water storage container to generate steam;

the main body comprises an opening through that the water storage container is attached and detached, a water supply door to open and close the opening, a non-magnetic portion that is provided in a part adjacent to the opening, and a ferromagnetic portion that is provided in the part adjacent to the opening; and the water supply door comprises at least one magnet disposed to face the non-magnetic portion and a rib on an inner surface of the water supply door that gathers water that drops from the steam supply device onto the inner surface of the water supply door.

12. The cooking apparatus according to claim 11, wherein the at least one magnet comprises a first magnet, a portion of which faces the ferromagnetic portion and the remainder of which faces the non-magnetic portion, and a second magnet the entirety of which faces all of the non-magnetic portion.

13. A cooking apparatus comprising:

a main body provided with a cooking chamber; and a steam supply device generating steam to supply the steam to the cooking chamber, wherein:

the steam supply device comprises a water storage container that is attachable to, and detachable from, the main body, and a steam generator that is supplied with water from the water storage container to generate steam;

the main body comprises an opening through that the water storage container is attached and detached, a water supply door to open and close the opening, a non-magnetic portion that is provided in a part adjacent to the opening, and a ferromagnetic that is provided in the part adjacent to the opening; and the water supply door comprises at least one magnet disposed to face the non-magnetic portion, wherein the main body comprises a button disposed in the part adjacent to the opening of the main body, a protrusion length of the button varying depending on a number of times the button is pressed.

14. A cooking apparatus comprising:

a main body provided with a cooking chamber;

a water storage unit to store water; and a steam generator that is supplied with water from the water storage unit to generate steam, wherein:

the water storage unit comprises a water storage case mounted within the main body and a water storage container that is separately installed to the water storage case;

the main body comprises an opening through which the water storage container is attached and detached, a water supply door that is rotatably mounted, at a lower end thereof, to the main body to open and close the opening; and the water supply door comprises a guide rib that is provided on an inner surface thereof and is formed in a U-shape oriented downward.

15. The cooking apparatus according to claim 14, wherein the water supply door comprises a guide portion extending rearward from an inner surface lower portion of the water supply door, a lower end of the guide rib being provided at both sides of the guide portion.

16. The cooking apparatus according to claim 15, wherein the guide portion extends to have an arc-shaped cross-section.

17. The cooking apparatus according to claim 14, wherein the water storage case comprises a drop water storage portion recessed downward at a lower portion thereof to receive and gather drop water that has dropped on the water storage case.

18. A steam supply device for a cooking apparatus, the steam supply device comprising:

a water storage unit to store water;

a steam generator that is supplied with water from the water storage unit to generate steam;

a water supply tube to transfer water in the water storage unit to the steam generator; and a water collection tube to transfer residual water in the steam generator to the water storage unit, wherein the water storage unit including an opening facing a front of the cooking apparatus that receives drop water that dropped on a door of the cooking apparatus.

* * * * *